US010699685B2

(12) United States Patent
Maezawa

(10) Patent No.: US 10,699,685 B2
(45) Date of Patent: Jun. 30, 2020

(54) TIMING PREDICTION METHOD AND TIMING PREDICTION DEVICE

(71) Applicant: Yamaha Corporation, Hamamatsu, Shizuoka (JP)

(72) Inventor: Akira Maezawa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 14 days.

(21) Appl. No.: 16/252,128

(22) Filed: Jan. 18, 2019

(65) Prior Publication Data

US 2019/0156802 A1 May 23, 2019

Related U.S. Application Data

(63) Continuation of application No. PCT/JP2017/026524, filed on Jul. 21, 2017.

(30) Foreign Application Priority Data

Jul. 22, 2016 (JP) ..... 2016-144348

(51) Int. Cl.

| | |
|---|---|
| ***G10H 1/26*** | (2006.01) |
| ***G10H 1/40*** | (2006.01) |
| ***G10H 1/00*** | (2006.01) |
| ***G10G 3/04*** | (2006.01) |

(52) U.S. Cl.

CPC ..... *G10H 1/26* (2013.01); *G10H 1/00* (2013.01); *G10H 1/0025* (2013.01); *G10H 1/0058* (2013.01); *G10H 1/40* (2013.01); *G10G 3/04* (2013.01); *G10H 2210/051* (2013.01); *G10H 2210/091* (2013.01); *G10H 2240/325* (2013.01); *G10H 2250/015* (2013.01)

(58) Field of Classification Search

CPC ..... G10H 1/26; G10H 1/00; G10H 1/0025; G10H 1/0058; G10H 1/40; G10H 2210/051; G10H 2210/091; G10H 2240/325; G10H 2250/015; G10G 3/04

USPC ..... 84/653

See application file for complete search history.

(56) References Cited

U.S. PATENT DOCUMENTS 5,005,461 A * 4/1991 Murata ..... G10H 1/0016 84/470 R
5,119,425 A * 6/1992 Rosenstrach ..... G10H 7/00 704/219

(Continued)

FOREIGN PATENT DOCUMENTS

JP 2011-180590 A 9/2011
JP 2012-168538 A 9/2012

(Continued)

OTHER PUBLICATIONS

International Search Report in PCT/JP2017/026524 dated Oct. 17, 2017.

*Primary Examiner* — David S Warren
*Assistant Examiner* — Christina M Schreiber
(74) *Attorney, Agent, or Firm* — Global IP Counselors, LLP

(57) ABSTRACT

A timing prediction method includes updating a state variable relating to the timing of a next sound generation event in a performance using a plurality of observation values relating to a timing of sound generation in a performance, and outputting an updated state variable that has been updated.

8 Claims, 4 Drawing Sheets

(56) References Cited

U.S. PATENT DOCUMENTS

| | | | | |
|---|---|---|---|---|
| 5,198,603 | A * | 3/1993 | Nishikawa | G10H 1/0058 84/601 |
| 5,286,910 | A * | 2/1994 | Hasebe | G10H 1/186 84/609 |
| 8,660,678 | B1 * | 2/2014 | Lavi | G10H 1/0066 700/94 |
| 8,865,992 | B2 * | 10/2014 | Shavit | G10H 1/055 84/615 |
| 2011/0214554 | A1 * | 9/2011 | Nakadai | G09B 15/02 84/477 R |
| 2014/0198921 | A1 * | 7/2014 | Klippel | H04R 29/001 381/59 |
| 2014/0260911 | A1 * | 9/2014 | Maezawa | G10H 1/00 84/612 |
| 2014/0266569 | A1 * | 9/2014 | Yoshikawa | G06F 3/04847 340/4.4 |
| 2018/0268793 | A1 * | 9/2018 | Sato | G10H 1/0008 |
| 2019/0096373 | A1 * | 3/2019 | Setoguchi | G10H 1/344 |
| 2019/0147837 | A1 * | 5/2019 | Maezawa | G10H 1/00 84/609 |
| 2019/0156801 | A1 * | 5/2019 | Maezawa | G10H 1/0058 |
| 2019/0156802 | A1 * | 5/2019 | Maezawa | G10H 1/40 |
| 2019/0156806 | A1 * | 5/2019 | Maezawa | G10G 3/04 |
| 2019/0156809 | A1 * | 5/2019 | Maezawa | G10H 1/40 |
| 2019/0172433 | A1 * | 6/2019 | Maezawa | G10H 1/40 |

FOREIGN PATENT DOCUMENTS

| | | | |
|---|---|---|---|
| JP | 2015-79183 | A | 4/2015 |
| JP | 2015079183 | A * | 4/2015 |

* cited by examiner

TIMING PREDICTION METHOD AND TIMING PREDICTION DEVICE

CROSS-REFERENCE TO RELATED APPLICATIONS

This application is a continuation application of International Application No. PCT/JP2017/026524, filed on Jul. 21, 2017, which claims priority to Japanese Patent Application No. 2016-144348 filed in Japan on Jul. 22, 2016. The entire disclosures of International Application No. PCT/JP2017/026524 and Japanese Patent Application No. 2016-144348 are hereby incorporated herein by reference.

BACKGROUND

Technological Field

The present invention relates to a timing prediction method and a timing prediction device.

Background Information

A technology for estimating a position of a performer's performance on a musical score based on a sound signal that indicates an emission of sound by the performer is known (for example, refer to Japanese Laid-Open Patent Application No. 2015-79183 (Patent Document 1)).

In an ensemble system in which a performer and an automatic performance instrument, and the like, play together, for example, a process is carried out for predicting a timing of an event in which the automatic performance instrument emits a next sound, based on an estimation result of a position of the performer's performance on a musical score. However, in such an ensemble system, there are cases in which an unexpected deviation of an input timing of a sound signal that indicates the performer's performance affects the prediction result of the timing of the event related to the performance.

SUMMARY

The present disclosure was made in light of the circumstance described above, and one solution thereto is to provide a technology for suppressing the influence of an unexpected deviation of the input timing of the sound signal that indicates the performer's performance, when the timing of the event related to the performance is predicted.

A timing prediction method according to an aspect of this disclosure includes updating a state variable relating to a timing of a next sound generation event in a performance, using a plurality of observation values relating to a timing of sound generation in the performance, and outputting an updated state variable that has been updated.

In addition, a timing prediction device according to an aspect of this disclosure includes an electronic controller including at least one processor. The electronic controller is configured to execute a plurality of modules including a reception module that receives two or more observation values relating to a timing of sound generation in a performance, and an updating module that updates a state variable relating to a timing of a next sound generation event in the performance, using a plurality of observation values among the two or more observation values.

DETAILED DESCRIPTION OF THE EMBODIMENTS

Selected embodiments will now be explained with reference to the drawings. It will be apparent to those skilled in the field of musical performances from this disclosure that the following descriptions of the embodiments are provided for illustration only and not for the purpose of limiting the invention as defined by the appended claims and their equivalents.

1. CONFIGURATION

Figure 1:
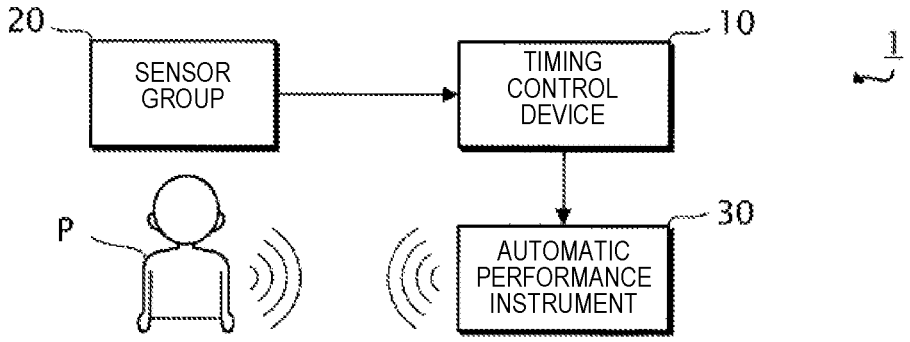
FIG. 1 is a block diagram showing a configuration of an ensemble system 1 according to one embodiment.

FIG. 1 is a block diagram showing a configuration of an ensemble system 1 according to the present embodiment. The ensemble system 1 is used for a human performer P and an automatic performance instrument 30 to execute a performance. That is, in the ensemble system 1, the automatic performance instrument 30 carries out a performance in accordance with the performance of the performer P. The ensemble system 1 comprises a timing control device 10, a sensor group 20, and the automatic performance instrument 30. In the present embodiment, a case in which a music piece that is played together by the performer P and the automatic performance instrument 30 will be assumed. That is, the timing control device 10 stores data which represent a musical score of the music piece that is played together by the performer P and the automatic performance instrument 30 (hereinafter referred to as "music data").

The performer P plays a musical instrument. The sensor group 20 detects information relating to the performance by the performer P. In the present embodiment, the sensor group 20 includes a microphone that is placed in front of the performer P. The microphone collects the sounds of the performance sound that, is emitted from the instrument that is played by the performer P, converts the collected performance sound into a sound signal and outputs the sound signal.

The timing control device 10 is a device for controlling a timing at which the automatic performance instrument 30 performs following the performance of the performer P. The timing control device 10 carries out three processes based on the sound signal that is supplied from the sensor group 20: (1) estimating the position of the performance on the musical score (can be referred to as "estimating the performance position"), (2) predicting the time (timing) at which a next sound should be emitted in the performance by the automatic performance instrument 30 (can be referred to as "predicting the sound generation time"), and (3) outputting a performance command with respect to the automatic performance instrument 30 (can be referred to as "outputting the performance command"). Here, estimating the performance position is a process for estimating the position on the musical score of the ensemble by the performer P and the automatic performance instrument 30. Predicting the sound generation time is a process for predicting the time at which the next sound generation should be carried out by the automatic performance instrument 30 using an estimation result of the performance position. Outputting the performance command is a process for outputting the performance command with respect to the automatic performance instrument 30 in accordance with the predicted sound generation time. The sound generated by the automatic performance instrument 30 is one example of a "sound generation event".

The automatic performance instrument 30 as a sound generation device carries out a performance in accordance with the performance command that is supplied by the timing control device 10, irrespective of human operation, one example being an automatic playing piano.

Figure 2:
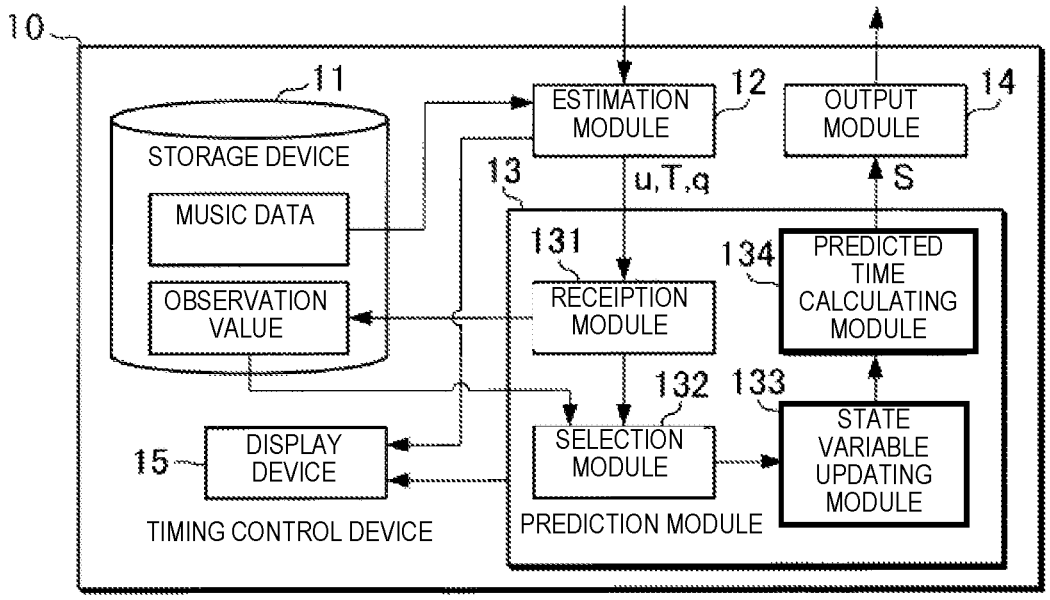
FIG. 2 is a block diagram illustrating a functional configuration of a timing control device 10.

FIG. 2 is a block diagram illustrating a functional configuration of the timing control device 10. The timing control device 10 comprises a storage device 11, an estimation module 12, a prediction module 13, an output module 14, and a display device 15.

The storage device 11 stores various data. In this example, the storage device 11 stores music data. The music data include at least tempo and pitch of the generated sounds that are designated by a musical score. The timing of generated sounds indicated by the music data is, for example, expressed based on time units time (for example, thirty-second notes) that are set on the musical score. In addition to the tempo and pitch of the generated sounds that are designated by the musical score, the music data can also include information that indicates at least one or more of sound length, tone, or sound volume each of which is designated by the musical score. For example, the music data are data in the MIDI (Musical Instrument Digital Interface) format.

The estimation module 12 analyzes the input sound signal and estimates the performance position on the musical score. The estimation module 12 first extracts information relating to the pitch and an onset time (sound generation start time) from the sound signal. Next, the estimation module 12 calculates, from the extracted information, a stochastic estimated value which indicates the performance position on the musical score. The estimation module 12 outputs the estimated value obtained by means of the calculation.

In the present embodiment, the estimated value that is output by the estimation module 12 includes a sound generation position u, an observation noise q, and a sound generation time T. The sound generation position u is the position on the musical score (for example, the second beat of the fifth measure), of a sound that is generated during the performance by the performer P. The observation noise q is the observation noise (stochastic fluctuation) of the sound generation position u. The sound generation position u and the observation noise q are expressed, for example, based on the time units that are set on the musical score. The sound generation time T is the time (position on a time axis) at which sound generated by the performer P is observed. In the description below, the sound generation position that corresponds to the nth music note that is sounded during the performance of the music piece is expressed as u[n] (where n is a natural number that satisfies n≥1). The same applies to the other estimated values.

The prediction module 13 predicts the time (predicts the sound generation time) at which the next sound generation should be carried out in the performance by the automatic performance instrument 30 by means of using the estimated value that is supplied from the estimation module 12 as an observation value. In the present embodiment, a case in which the prediction module 13 predicts the sound generation time using a so-called Kalman filter will be assumed as an example.

Hereinbelow, the prediction of the sound generation time according to the related technology will be described before the prediction of the sound generation time according to the present embodiment is described. Specifically, the prediction of the sound generation time using a regression model and the prediction of the sound generation time using a dynamic model will be described as the prediction of the sound generation time according to the related technology.

First, with regard to the prediction of the sound generation time according to the related technology, the prediction of the sound generation time using the regression model will be described.

The regression model estimates the next sound generation time using the history of the times that sounds were generated by the performer P and the automatic performance instrument 30. The regression model can be expressed by the following equation (1), for example.

Equation $$S[n+1] = G_n \begin{pmatrix} S[n] \\ S[n-1] \\ \vdots \\ S[n-j] \end{pmatrix} + H_n \begin{pmatrix} u[n] \\ u[n-1] \\ \vdots \\ u[n-j] \end{pmatrix} + \alpha_n \tag{1}$$

Here, the sound generation time S[n] is the sound generation time of the automatic performance instrument 30. The sound generation position u[n] is the sound generation position of the performer P. In the regression model shown in equation (1), a case is assumed in which the sound generation time is predicted using "j+1" observation values (where j is a natural number that satisfies 1≤j<n). In the description relating to the regression model shown in equation (1), a case is assumed in which the sound performed by the performer P can be distinguished from the performance sound of the automatic performance instrument 30. The matrix $G_n$ and the matrix $H_n$ are matrices corresponding to regression coefficients. The subscript n in the matrix $G_n$, the matrix $H_n$, and the coefficient $\alpha_n$ indicates that the matrix $G_n$, the matrix $H_n$, and the coefficient $\alpha_n$ are elements that correspond to the nth music note that is played. That is, when using the regression model shown in equation (1), the matrix $G_n$, the matrix $H_n$, and the coefficient $\alpha_n$ can be set in one-to-one correspondence with a plurality of music notes that are included in the musical score of the music piece. In other words, it is possible to set the matrix $G_n$, the matrix $H_n$, and the coefficient $\alpha_n$ in accordance with the position on the musical score. As a result, according to the regression model shown in equation (1), it becomes possible to predict the sound generation time S in accordance with the position on the musical score.

In this manner, although the regression model shown in equation (1) has the benefit of being capable of predicting the sound generation time S in accordance with the position on the musical score, the regression model has the following problems. The first problem is the point that it is necessary to conduct learning (rehearsal) in advance by means of human performance in order to set the matrix G and the matrix H. The second problem is the point that, in the regression model shown in equation (1), a continuity between the sound generation time S[n−1] and the sound generation time S[n] is not ensured; therefore, when an unexpected deviation occurs in the sound generation position u[n], there is the possibility that the behavior of the automatic performance instrument 30 changes abruptly.

Next, with regard to the prediction of the sound generation time according to the related technology, the prediction of the sound generation time using the dynamic model will be described.

In general, in the dynamic model, a state vector V that represents a state of a dynamic system to be a target of prediction by the dynamic model is updated by means of the following process, for example.

Specifically, first, the dynamic model predicts the state vector V after a change from the state vector V before the change, using a state transition model, which is a theoretical model that represents temporal changes in the dynamic system. Second, the dynamic model predicts the observation value from a predicted value of the state vector V according to the state transition model, using an observation model, which is a theoretical model that represents the relationship between the state vector V and the observation value. Third, the dynamic model calculates an observation residual based on the observation value predicted by the observation model and the observation value that is actually supplied from outside of the dynamic model. Fourth, the dynamic model calculates an updated state vector V by correcting the predicted value of the state vector V according to the state transition model by using the observation residual.

In the present embodiment, a case is assumed in which the state vector V includes a performance position x and a velocity v as elements, for example. Here, the performance position x is a state variable that represents the estimated value of the performance position of the performer P on the musical score. In addition, the velocity v is a state variable that represents the estimated value of the velocity (tempo) of the performance by the performer P on the musical score. However, the state vector V can include a state variable other than the performance position x and the velocity v.

In the present embodiment, a case is assumed in which the state transition model is represented by the following equation (2), and the observation model is represented by the following equation (3), for example.

Equation $$V[n]=A_n V[n-1]+e[n] \tag{2}$$

Equation $$u[n]=O_n V[n]+q[n] \tag{3}$$

Here, the state vector V[n] is a k-dimensional vector (where k is a natural number that satisfies k≥2), having as elements a plurality of state variables including the performance position x[n] and the velocity v[n], which correspond to the nth music note that is played. The process noise e[n] is a k-dimensional vector that represents noise which accompanies a state transition that uses the state transition model. The matrix An represents the coefficient that relates to the updating of the state vector V in the state transition model. The matrix On is represents the relationship between the observation value (in this example, the sound generation position u) and the state vector V in the observation model. The subscript n appended to each type of element, such as the matrices and the variables, indicates that said element corresponds to the nth music note.

Equations (2) and (3) can be embodied, for example, as the following equation (4) and equation (5).

Equation $$\begin{pmatrix} x[n] \\ v[n] \end{pmatrix} = \begin{pmatrix} 1 & T[n]-T[n-1] \\ 0 & 1 \end{pmatrix} \begin{pmatrix} x[n-1] \\ v[n-1] \end{pmatrix} + e[n] \tag{4}$$

Equation $$u[n] = x[n] + q[n] \tag{5}$$

If the performance position x[n] and the velocity v[n] can be obtained from equations (4) and (5), it is possible to obtain the performance position x[t] at a future time t from the following equation (6).

Equation $$x[t]=x[n]+v[n](t-T[n]) \tag{6}$$

By applying the calculation result according to equation (6) to the following equation (7), it is possible to calculate the sound, generation time S[n+1] at which the automatic performance instrument 30 should sound the (n+1)th music note.

Equation $$S[n+1] = T[n] + \frac{x[n+1]-x[n]}{v[n]} \tag{7}$$

The dynamic model has the advantage that it is possible to predict the sound generation time S corresponding to the position on the musical score. In addition, the dynamic model has the advantage that, in principle, parameter tuning (learning) in advance is not necessary. Furthermore, because the dynamic model takes into consideration the continuity between the sound generation time S[n−1] and the sound generation time S[n, there is the benefit that it is possible to more effectively suppress a fluctuation in the behavior of the automatic performance instrument 30 due to the unexpected deviation of the sound generation position u[n], compared with the regression model.

However, in the dynamic model described above, particularly in the prediction of the observation value using the observation model and the calculation of the observation residual based on the observation value that is supplied from the outside, only the last observation value of the sound generation position u[n], the observation noise q[n], etc., that corresponds to the nth music note is used; therefore, there is the possibility that the behavior of the automatic performance instrument 30 will fluctuate due to the unexpected deviation of the observation value, such as the sound generation position u[n]. As a result, for example, if a deviation occurs in the estimation of the sound generation position u of the performer P, the timing of the sound generated by the automatic performance instrument 30 also deviates due to said deviation, which leads to a disturbance in the performance timing by the automatic performance instrument 30.

In contrast, the prediction module 13 according to the present embodiment carries out the prediction of the sound generation time which is based on the dynamic model described above and with which it is possible to more effectively suppress the fluctuation in the behavior of the automatic performance instrument 30 caused by the unexpected deviation of the sound generation position u[n], compared with the dynamic model described above.

Specifically, the prediction module 13 according to the present embodiment employs the dynamic model that updates the state vector V using a plurality of observation values that are supplied from the estimation module 12 at a plurality of prior points in time, in addition to the last observation value. In the present embodiment, the plurality of observation values that are supplied at a plurality of prior points in time are stored in the storage device 11. The prediction module 13 includes a reception module 131, a selection module 132, a state variable updating module 133, and a predicted time calculating module 134.

The reception module 131 receives an input of the observation values relating to the timing of the performance. In the present embodiment, the observation values relating to the timing of the performance are the sound generation position u and the sound generation time T. In addition, the reception module 131 receives an input of the observation value accompanying the observation values relating to the timing of the performance. In the present embodiment, the accompanying observation value is the observation noise q. The reception module 131 stores the received observation values in the storage device 11.

The selection module 132 selects the plurality of observation values that are used for updating the state vector V from among the plurality of observation values corresponding to the plurality of points in time stored in the storage device 11. For example, the selection module 132 selects the plurality of observation values that are used for updating the state vector V based on some or all of the following: a time at which the reception module 131 receives the observation value, a position on the musical score corresponding to the observation value, and a number of the observation values to be selected. More specifically, in a period from a point in time that is before the current time by a designated period of time to the current time (one example of a "selection period"; for example, the last 30 seconds), the selection module 132 can select the observation value that is received by the reception module 131 (hereinafter, this mode of selection is referred to as the "selection based on the time filter"). In addition, the selection module 132 can select the observation value that corresponds to the music note that is positioned in a designated range in the musical score (for example, the last two measures) (hereinafter, this mode of selection is referred to as the "section based on the number of measures"). Additionally, the selection module 132 can select a designated number of observation values including the last observation value (for example, the observation values that correspond to the last five notes) (hereinbelow, this mode of selection is referred to as the "selection based on the number of music notes").

The state variable updating module 133 updates the state variable V (state variable) in the dynamic model. For example, equation (4) (shown again) and the following equation (8) are used for updating the state vector V. The state variable updating module 133 outputs the updated state variable V (state variable).

Equation $$\begin{pmatrix} x[n] \\ v[n] \end{pmatrix} = \begin{pmatrix} 1 & T[n]-T[n-1] \\ 0 & 1 \end{pmatrix} \begin{pmatrix} x[n-1] \\ v[n-1] \end{pmatrix} + e[n] \tag{4}$$

Equation

-continued $$\begin{pmatrix} u[n-1] \\ u[n-2] \\ \vdots \\ u[n-j] \end{pmatrix} = O_n \begin{pmatrix} x[n] \\ v[n] \end{pmatrix} + \begin{pmatrix} q[n-1] \\ q[n-2] \\ \vdots \\ q[n-j] \end{pmatrix} \tag{5}$$

Here, the vector $(u[n-1], u[n-2], \ldots, u[n-j])^T$ on the left side of equation (8) is an observation vector U[n] that indicates the result of predicting the plurality of sound generation positions u that are supplied from the estimation module 12 at a plurality of points in time according to the observation model.

The predicted time calculating module 134 calculates the sound generation time S[n+1], which is the time of the next sound generated by the automatic performance instrument 30, using performance position x[n] and the velocity v[n] which are included in the updated state vector V[n]. Specifically, first, the predicted time calculating module 134 applies the performance position x[n] and the velocity v[n], which are included in the state vector V[n] updated by the state variable updating module 133, to equation (6) to calculate the performance position x[t] at future time t. Next, the predicted time calculating module 134 uses equation (7) to calculate the sound generation time S[n+1] at which the automatic performance instrument 30 should sound the (n+1)th music note.

In equation (8), because consideration is given to the plurality of sound generation positions u[n−1] to u[n−j] that are supplied from the estimation module 12 at a plurality of points in time, for example, compared to an example in which only the sound generation position u[n] at the latest time is considered, as in equation (5), it is possible to carry out the prediction of the sound generation time S that is robust against the unexpected deviation of the sound generation position u[n]. The predicted time calculating module 134 outputs the calculated sound generation time S.

The output module 14 outputs the performance command corresponding to the music note that the automatic performance instrument 30 should sound next to the automatic performance instrument 30, in accordance with the sound generation time S[n+1] that is input from the prediction module 13. The timing control device 10 has an internal clock (not shown) and measures the time. The performance command is described according to a designated data format. The designated data format is, for example, MIDI. The performance command includes a note-on message, a note number, and velocity.

The display device 15 displays information relating to the estimation result of the performance position, and information relating to a prediction result of the next sound generation time by the automatic performance instrument 30. The information relating to the estimation result of the performance position includes, for example, at least one or more of the musical score, a frequency spectrogram of the sound signal that is input, or a probability distribution of the estimated value of the performance position. The information relating to the prediction result of the next sound generation time includes, for example, various state variables of the state vector V. By means of the display of information relating to the estimation result of the performance position and the information relating to the prediction result of the next sound generation time by the display device 15, it is possible for the operator of the timing control device 10 to ascertain the operation state of the ensemble system 1.

Figure 3:
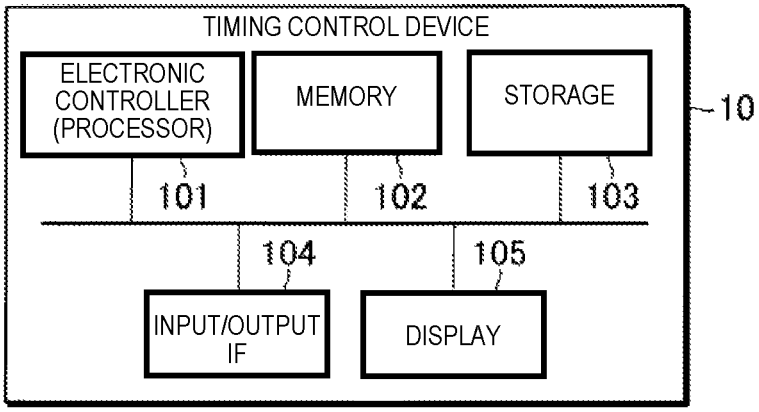
FIG. 3 is a block diagram illustrating a hardware configuration of the timing control device.

FIG. 3 is a view illustrating a hardware configuration of the timing control device 10. The timing control device 10 is a computer device comprising an electronic controller (processor) 101, a memory 102, a storage 103, an input/output IF 104, and a display 105.

The electronic controller 101 is, for example, a CPU (Central Processing Unit), and controls each module and device of the timing control device 10. The electronic controller 101 includes at least one processor. The term "electronic controller" as used herein refers to hardware that executes software programs. The electronic controller 101 can be configured to comprise, instead of the CPU or in addition to the CPU, programmable logic devices such as a DSP (Digital Signal Processor), an FPGA (Field Programmable Gate Array), and the like. In addition, the electronic controller 101 can include a plurality of CPUs (or a plurality of programmable logic devices). The memory 102 is a non-transitory storage medium, and is, for example, a nonvolatile memory such as a RAM (Random Access Memory). The memory 102 functions as a work area when the processor of the electronic controller 101 executes a control program, which is described further below. The storage 103 is a non-transitory storage medium and is, for example, a nonvolatile memory such as an EEPROM (Electrically Erasable Programmable Read-Only Memory). The storage 103 stores various programs, such as a control program, for controlling the timing control device 10, as well as various data. The input/output IF 104 is an interface for inputting signals from or outputting signals to other devices. The input/output IF 104 includes, for example, a microphone input and a MIDI output. The display 105 is a device for outputting various information, and includes, for example, an LCD (Liquid Crystal Display).

The processor of the electronic controller 101 executes the control program that is stored in the storage 103 and operates according to the control program to thereby function as the estimation module 12, the prediction module 13, and the output module 14. One or both of the memory 102 and the storage 103 can function as the storage device 11. The display 105 can function as the display device 15.

2. OPERATION

Figure 4:
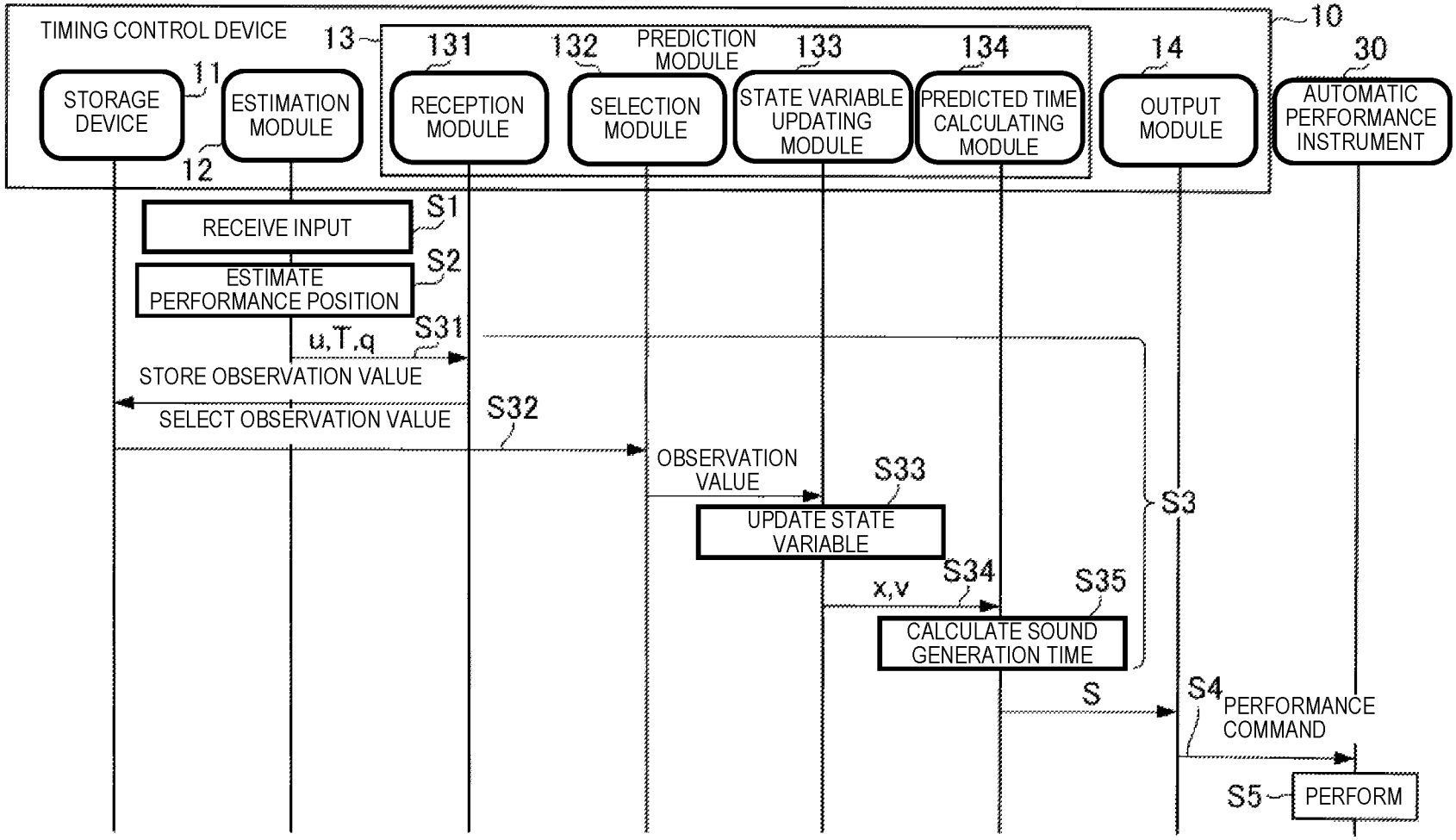
FIG. 4 is a sequence chart illustrating an operation of the timing control device.

FIG. 4 is a sequence chart illustrating an operation of the timing control device 10. The sequence chart of FIG. 4 is started, for example, when triggered by the processor of the electronic controller 101 activating the control program.

In Step S1, the estimation module 12 receives the input of the sound signal. When the sound signal is an analog signal, for example, the sound signal is converted into a digital signal by a D/A converter (not shown) that is provided in the timing control device 10, and the sound signal that has been converted into a digital signal is input to the estimation module 12.

In Step S2, the estimation module 12 analyzes the sound signal and estimates the performance position on the musical score. The process relating to Step S2 is carried out, for example, in the following manner. In the present embodiment, the transition of the performance position on the musical score (musical score time series) is described using a probability model. By using the probability model to describe the musical score time series, it is possible to deal with such problems as mistakes in the performance, omission of repeats in the performance, fluctuation in the tempo of the performance, and uncertainty in the pitch or the sound generation time in the performance. An example of the probability model that describes the musical score time series that can be used is the hidden Semi Markov model (Hidden Semi-Markov Model, HSMM). The estimation module 12 obtains the frequency spectrogram by, for example, dividing the sound signal into frames and applying a constant-Q transform. The estimation module 12 extracts the onset time and the pitch from the frequency spectrogram. For example, the estimation module 12 successively estimates the distribution of the stochastic estimated values which indicate the performance position on the musical score by means of Delayed-decision, and outputs a Laplace approximation of the distribution and one or more statistical quantities at the point in time at which the peak of the distribution passes the position that is considered the beginning of the musical score. Specifically, when the sound generation that corresponds to the nth music note that exists on the music data is detected, the estimation module 12 outputs the sound generation time T[n] at which the sound generation is detected, and the average position on the musical score in the distribution that indicates the stochastic position of the sound generation on the musical score, and the variance. The average position on the musical score is the estimated value of the sound generation position u[n], and the variance is the estimated value of the observation noise q[n]. Details of the estimation of the sound generation position is disclosed in, for example, Japanese Laid-Open Patent Application No. 2015-79183.

Figure 5:
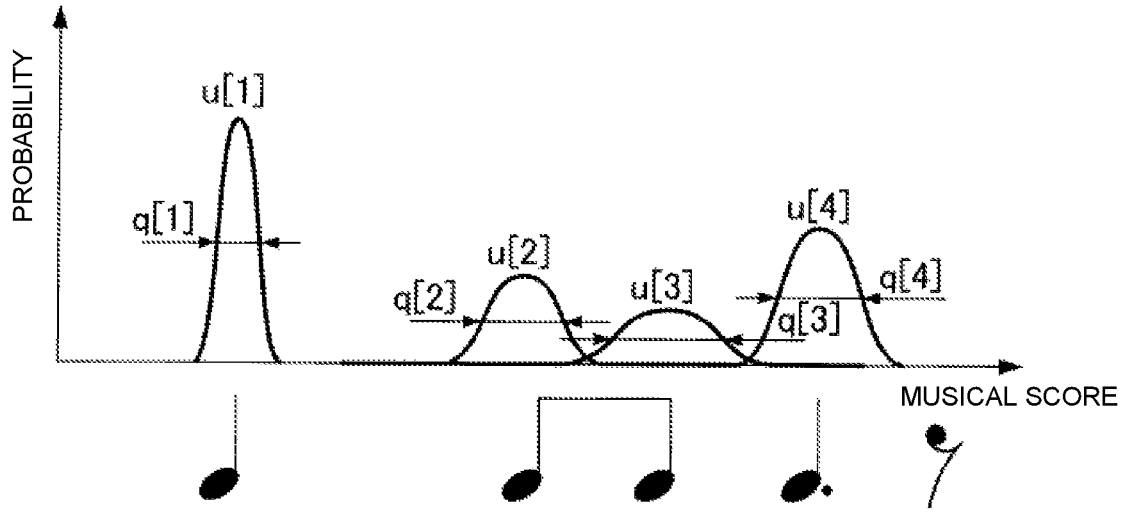
FIG. 5 is a view illustrating a sound generation position u[n] and an observation noise q[n].

FIG. 5 is a view illustrating the sound generation position u[n] and the observation noise q[n]. In the example shown in FIG. 5, a case in which four music notes are included in one bar of the musical score is illustrated. The estimation module 12 calculates the probability distributions P[1]-P[4], which correspond one-to-one with four generated sounds corresponding to four music notes included in the one bar. Then, the estimation module 12 outputs the sound generation time T[n], the sound generation position u[n], and the observation noise q[n], based on the calculation result.

FIG. 4 is referred to again. In Step S3, the prediction module 13 predicts the next sound generation time by the automatic performance instrument 30 using the estimated value that is supplied from the estimation module 12 as the observation value. One example of the details of the process in Step S3 will be described below.

In Step S3, the reception module 131 receives input of the observation values such as the sound generation position u, the sound generation time T, and the observation noise q, supplied from the estimation module 12 (Step S31). Furthermore, the reception module 131 stores these observation values in the storage device 11. The storage device 11 stores, for example, the observation values that are received by the reception module 131 at least for a designated period of time. That is, a plurality of observation values, which are received by the reception module 131 during a period from a point in time before the current time by a designated period of time to the current time, are stored in the storage device 11.

In Step S3, the selection module 132 selects the plurality of observation values that are used to update the state variable from among the plurality of observation values (one example of "two or more observation values") that are stored in the storage device 11 (Step S32). Then, the selection module 132 reads out the selected plurality of observation values from the storage device 11 and outputs the observation values to the state variable updating module 133.

In Step S3, the state variable updating module 133 updates each of the state variables of the state vector V using the plurality of observation values that are input from the selection module 132 (Step S33). In the following description, the state variable updating module 133 updates the state vector V (the performance position x and the velocity v, which are the state variables) using the following equations (9) to (11). That is, a case in which equation (9) and equation (10) are used instead of equation (4) and equation (8) when the state vector V is updated will be described below as an example. More specifically, a case in which equation (9) is employed instead of equation (4) described above as the state transition model will be described below. In addition, the following equation (10) is one example of the observation model according to the present embodiment, and is one example of an equation that embodies equation (8). The state variable updating module 133 outputs the state vector V that is updated using equations (9) to (11) to the predicted time calculating module 134 (Step S34).

Equation $$\begin{pmatrix} x[n] \\ v[n] \end{pmatrix} = \begin{pmatrix} 1 & T[n]-T[n-1] \\ 0 & \alpha \end{pmatrix} \begin{pmatrix} x[n-1] \\ v[n-1] \end{pmatrix} + \begin{pmatrix} 0 \\ (1-\alpha)v_{def}[n] \end{pmatrix} + e[n] \tag{9}$$

Equation $$\begin{pmatrix} u[n-1] \\ u[n-2] \\ \vdots \\ u[n-j] \end{pmatrix} = \begin{pmatrix} 1 & -T[n]+T[n-1] \\ 1 & -T[n]+T[n-2] \\ \vdots & \vdots \\ 1 & -T[n]+T[n-j] \end{pmatrix} \begin{pmatrix} x[n] \\ v[n] \end{pmatrix} + \begin{pmatrix} q[n-1] \\ q[n-2] \\ \vdots \\ q[n-j] \end{pmatrix} \tag{10}$$

Equation $$e[n] \sim N\left(0, \begin{pmatrix} \frac{(T[n]-T[n-1])^4}{4} & \frac{(T[n]-T[n-1])^3}{2} \\ \frac{(T[n]-T[n-1])^3}{2} & () \end{pmatrix} \sigma_a^2\right) \tag{11}$$

Here, the second term on the right side of equation (9) is a term for bringing the velocity v (tempo) back to a reference velocity $v_{def}[n]$. The reference velocity $v_{def}[n]$ can be constant throughout the music piece, or, conversely, different values can be set thereto according to the position in the music piece. For example, the reference velocity $v_{def}[n]$ can be set, such that the tempo of the performance changes extremely at a specific location in the music piece, or can be set such that the performance has human-like fluctuations in the tempo. When expressing equation (11) as "x~N(m, s)", "x" is a probability variable that is generated from a normal distribution with a mean of "m" and a variance of "s".

In Step S3, the predicted time calculating module 134 applies the performance position x[n] and the velocity v[n], which are state variables of the state vector V, that are input from the state variable updating module 133 to equations (6) and (7), and calculates the sound generation time S[n+1] at which the (n+1)th music note should be sounded (Step S35). Then, the predicted time calculating module 134 outputs the sound generation time S[n+l] obtained by the calculation to the output module 14.

Figure 6:
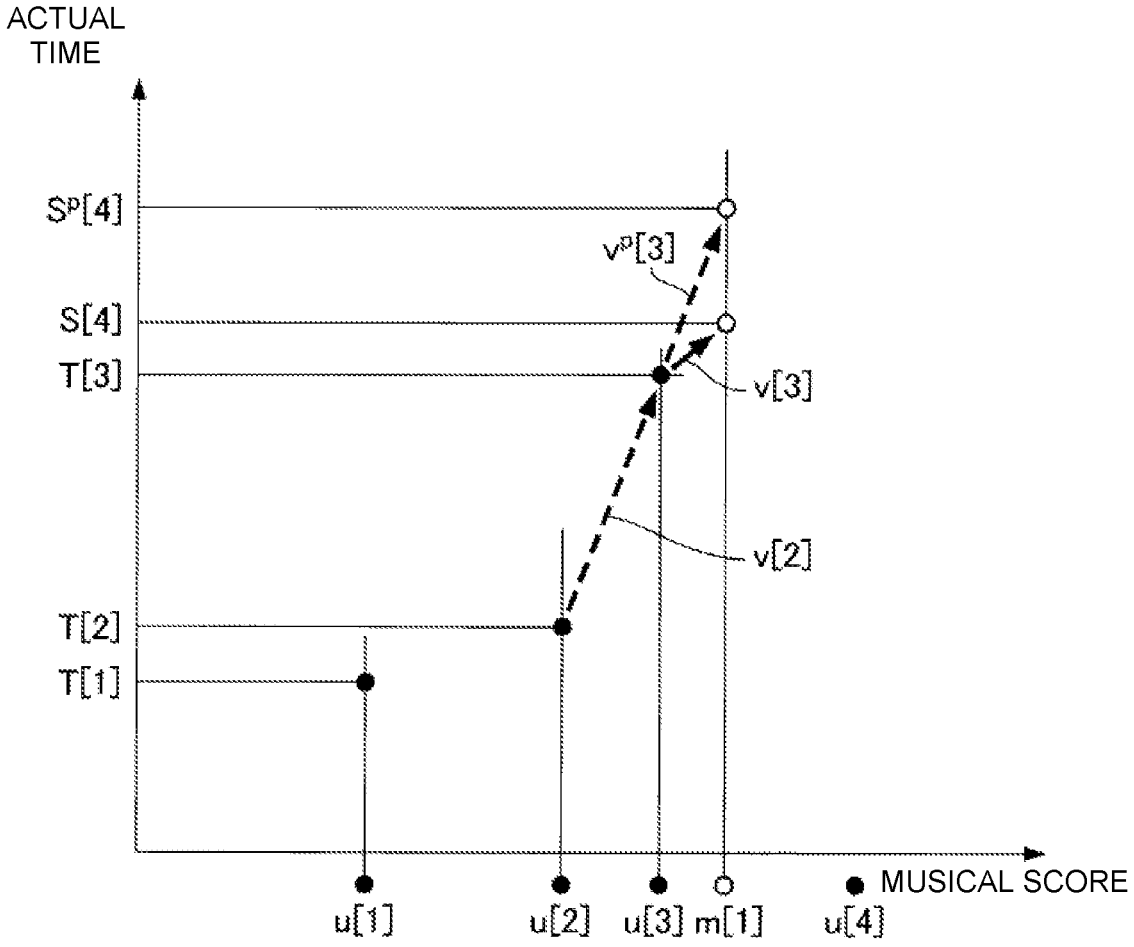
FIG. 6 is an explanatory view for explaining a prediction of a sound generation time according to the present embodiment.

FIG. 6 is an explanatory view for explaining the prediction of the sound generation time according to the present embodiment. In the example shown in FIG. 6, the music note that corresponds to the first sound generated by the automatic performance instrument 30 after the sound generation positions u[1] to u[3] are supplied from the estimation module 12 is set to m[1]. Then, in the example shown in FIG. 6, a case is illustrated in which the sound generation time S[4] at which the automatic performance instrument 30 should sound the music note m[1] is predicted. In the example shown in FIG. 6, for the sake of simplifying the explanation, the performance position x[n] and the sound generation position u[n] are assumed to be the same position.

In the example shown in FIG. 6, a case is evaluated in which the sound generation time S[4] is predicted according to the dynamic model shown in equations (4) and (5) (that is, the "dynamic model according to the related technology"). Hereinbelow, for the sake of convenience of the explanation, the sound generation time that is predicted when applying the dynamic model according to the related technology is expressed as "$S^P$", and the velocity of the performance from among the state variables that are obtained when applying the dynamic model according to the related technology will be expressed as "$v^P$". In the dynamic model according to the related technology, only the last observation value is considered when updating the state vector V. Accordingly, in the dynamic model according to the related technology, compared to a case in which a plurality of observation values are considered, the freedom to change of the velocity $v^P$[3], which is obtained corresponding to the third music note, relative to the velocity $v^P$[2], which is obtained corresponding to the second music note, becomes less. Therefore, in the dynamic model according to the related technology, the influence from the sound generation position u[3] in the prediction of the sound generation time $S^P$[4] becomes greater compared to a case in which a plurality of observation values are considered.

In contrast, according to the present embodiment, because the plurality of observation values that are supplied from the estimation module 12 at a plurality of prior points in time are taken into consideration, compared to the dynamic model according to the related technology, it is possible to increase the freedom to change of the velocity v[3], which is obtained corresponding to the third music note, relative to the velocity v[2], which is obtained corresponding to the second music note. Therefore, according to the present embodiment, it is possible to reduce the influence from the sound generation position u[3] when predicting the sound generation time S[4], compared to the dynamic model according to the related technology. Therefore, according to the present embodiment, it is possible to keep the influence of the unexpected deviation of the observation value low (for example, the sound generation position u[3]) when predicting the sound generation time S[n] (for example, the sound generation time S[4]), compared with the dynamic model according to the related technology.

FIG. 4 is referred to again. When the sound generation time S[n+1] that is input from the prediction module 13 arrives, the output module 14 outputs the performance command corresponding to the (n+1)th music note that the automatic performance instrument 30 should sound next to the automatic performance instrument 30 (Step S4). In practice, when delays in the process in the output module 14 and the automatic performance instrument 30 are taken into consideration, it is necessary to output the performance command at a time that is earlier than the sound generation time S[n+1] that is predicted by the prediction module 13, but an explanation thereof is omitted here. The automatic performance instrument 30 emits a sound in accordance with the performance command that is supplied from the timing control device 10 (Step S5).

The prediction module 13 determines whether or not the performance has ended at a designated timing. Specifically, the prediction module 13 determines the end of the performance based on, for example, the performance position that is estimated by the estimation module 12. When the performance position reaches a designated end point, the prediction module 13 determines that the performance has ended. When it is determined that the performance has ended, the timing control device 10 ends the process shown in the sequence chart of FIG. 4. If it is determined that the performance has not ended, the timing control device 10 and the automatic performance instrument 30 repeatedly execute the process of Steps S1 to S5.

Figure 7:
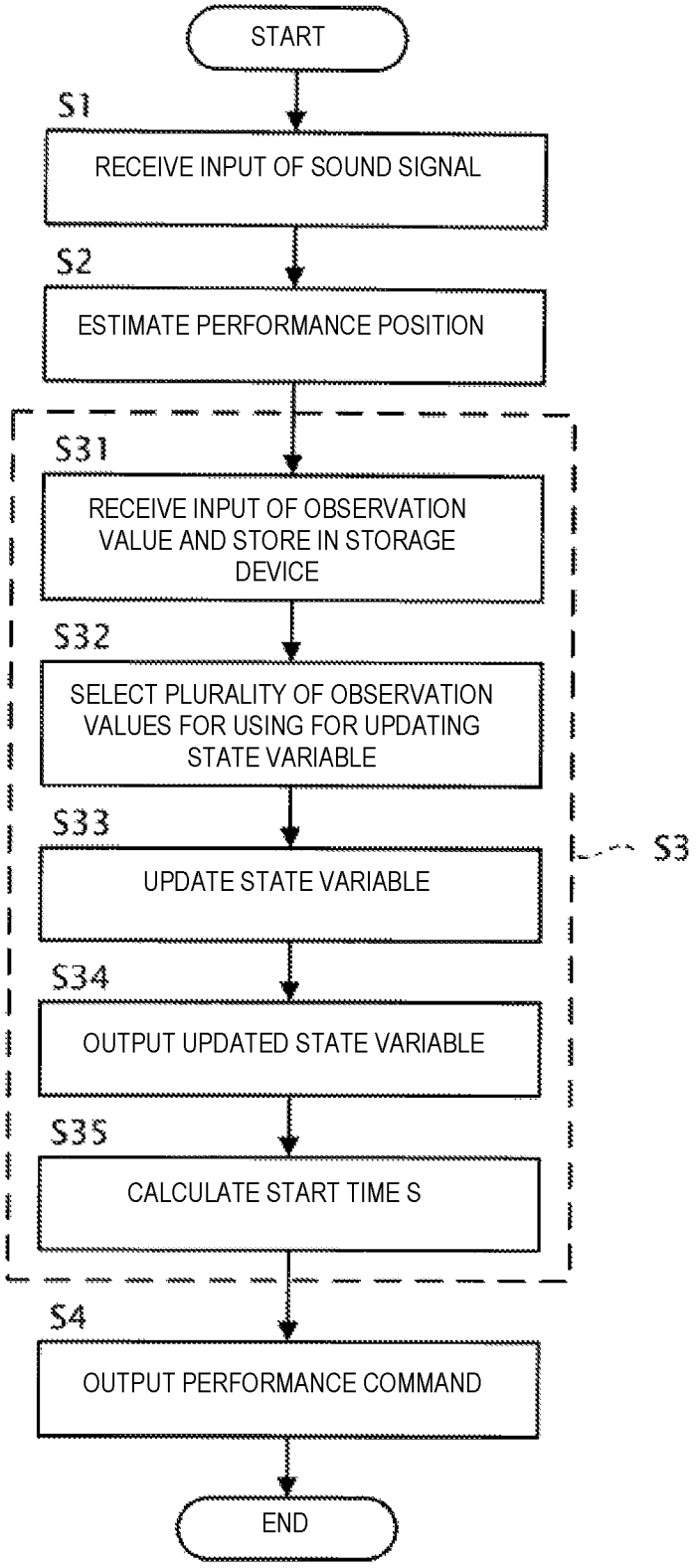
FIG. 7 is a flowchart illustrating the operation of the timing control device 10.

The operation of the timing control device 10 shown in the sequence chart of FIG. 4 can also be expressed as the flowchart of FIG. 7. That is, in Step S1, the estimation module 12 receives the input of the sound signal. In Step S2, the estimation module 12 estimates the performance position on the musical score. In Step S31, the reception module 131 receives the input of the observation values that are supplied from the estimation module 12 and stores the received observation values in the storage device 11. In Step S32, the selection module 132 selects the plurality of observation values that are used for updating the state variable from among the two or more observation values that are stored in the storage device 11. In Step S33, the state variable updating module 133 updates each of the state variables of the state vector V, using the plurality of observation values that are selected by the selection module 132. In Step S34, the state variable updating module 133 outputs the state variables updated in Step S33 to the predicted time calculating module 134. In Step S35, the predicted time calculating module 134 calculates the sound generation time S[n+1] using the updated state variables that are output from the state variable updating module 133. In Step S4, the output module 14 outputs the performance command to the automatic performance instrument 30 based on the sound generation time S[n+1] to cause the automatic performance instrument 30 to emit a sound at the sound generation time S[n+1].

3. MODIFIED EXAMPLES

The present embodiment is not limited to the embodiment described above, and various modifications are possible. Several modified examples will be described below. Two or more of the following modified examples can be used in combination.

3-1. First Modified Example

The device to be the subject of the timing control by the timing control device 10 (hereinafter referred to as "control target device") is not limited to the automatic performance instrument 30 as the sound generation device. That is, the "next event," the timing of which is predicted by the prediction module 13, is not limited to the next sound generated by the automatic performance instrument 30. The control target device can be, for example, a device for generating images that change synchronously with the performance of the performer P (for example, a device that generates computer graphics that change in real time), or a display device (for example a projector or a direct view display) that changes the image synchronously with the performance of the performer P. In another example, the control target device can be a robot that carries out an operation, such as dance, etc., synchronously with the performance of the performer P.

3-2. Second Modified Example

It is not necessary that the performer P be human. That is, the performance sound of another automatic performance instrument that is different from the automatic performance instrument 30 can be input into the timing control device 10.

According to this example, in the ensemble of a plurality of automatic performance instruments, it is possible to cause the performance timing of one of the automatic performance instruments to follow the performance timing of the other automatic performance instruments in real time.

3-3. Third Modified Example

The numbers of performers P and the automatic performance instruments 30 are not limited to those illustrated in the embodiment. The ensemble system 1 can include two or more of the performers P and/or of the automatic performance instruments 30.

3-4. Fourth Modified Example

The functional configuration of the timing control device 10 is not limited to that illustrated in the embodiment. A part of the functional elements illustrated in FIG. 2 can be omitted. For example, it is not necessary for the timing control device 10 to include the selection module 132. In this case, for example, the storage device 11 stores only one or a plurality of observation values that satisfy a designated condition, and the state variable updating module 133 updates the state variables using all of the observation values that are stored in the storage device 11.

Here, examples of the designated condition include "a condition that the observation value is an observation value that is received by the reception module 131 in a period from a point in time that is before the current time by a designated period of time to the current time," "a condition that the observation value is an observation value that corresponds to the music note that is positioned in a designated range on the musical score," and "a condition that the observation value is an observation value that corresponds to the music note that is within a designated number counted from the music note that corresponds to the last observation value."

In another example, it is not necessary for the timing control device 10 to include the predicted time calculating module 134. In this case, the timing control device 10 can simply output the state variables, which the state vector V has, that have been updated by the state variable updating module 133. In this case, the timing of the next event (for example, the sound generation time S[n+1]) can be calculated in a device other than the timing control device 10 into which the state variables, which the state vector V has, that have been updated by the state variable updating module 133 are input. In addition, in this case, a process other than the calculation of the timing of the next event (for example, displaying an image that visualizes the state variables) can be carried out by the device other than the timing control device 10. In another example, it is not necessary for the timing control device 10 to include the display device 15.

3-5. Fifth Modified Example

The observation value relating to the timing of the performance that is input to the reception module 131 is not limited to values relating to the performance sound of the performer P. In addition to the sound generation position u and the sound generation time T, which are observation values relating to the performance timing of the performer P (one example of the first observation values), the sound generation time S, which is the observation value relating to the performance timing of the automatic performance instrument 30 (one example of the second observation value) can be input into the reception module 131. In this case, the prediction module 13 can carry out a calculation under the assumption that the performance sound of the performer P and the performance sound of the automatic performance instrument 30 share common state variables. Specifically, the state variable updating module 133 according to the present modified example can update the state vector V under the assumption that, for example, the performance position x represents both the estimated position of the performance by the performer P on the musical score and the estimated position of the performance by the automatic performance instrument 30 on the musical score, and that the velocity v represents both the estimated value of the velocity of the performance by the performer P on the musical score and the estimated value of the velocity of the performance by the automatic performance instrument 30 on the musical score.

3-6. Sixth Modified Example

The method with which the selection module 132 selects the plurality of observation values that are used for updating the state variables from among the plurality of observation values corresponding to the plurality of points in time is not limited to that illustrated in the embodiment.

The selection module 132 can exclude a portion of the plurality of observation values that are selected by means of the method illustrated in the embodiment. For example, the observation values to be excluded are those in which the observation noise q that corresponds to the observation value is greater than a designated reference value. For example, the observation values that are excluded can be those in which the deviation from a designated regression line is larger than a designated reference value. The regression line is determined, for example, by preliminary learning (rehearsal). According to this example, it is possible to exclude observation values that tend to be performance errors. Alternatively, the observation values that are excluded can be determined using information relating to the music piece that is described in the musical score. Specifically, the selection module 132 can exclude the observation values that correspond to music notes to which are appended a specific music symbol (for example, fermata). Conversely, the selection module 132 can select only the observation values that correspond to music notes to which are appended a specific music symbol. According to this example, it is possible to select observation values using information relating to the music piece that is described in the musical score.

In another example, the method with which the selection module 132 selects the plurality of observation values that are used to update the state variables from among the plurality of observation values corresponding to the plurality of points in time can be set in advance according to the position on the musical score. For example, the method can be set such that consideration is given to the observation values of the last 10 seconds from the start of the music piece to the 20th measure, consideration is given to the observation values of the last four notes from the 21st measure to the 30th measure, and consideration is given to the observation values of the last two measures from the 31st measure to the end point. According to this example, it is possible to observe the degree of influence with respect to the unexpected deviation of the observation value according to the position on the musical score. In this case, a section in which consideration is given only to the last observation value can be included in a portion of the music piece.

3-7. Seventh Modified Example

The method with which the selection module 132 selects the plurality of observation values that are used for updating the state variables from among the plurality of observation values corresponding to the plurality of points in time can be changed according to the ratio of the density of the music notes of the performance sound of the performer P and of the performance sound of the automatic performance instrument 30. Specifically, the plurality of observation values that are used for updating the state variables can be selected according to the ratio of the density of the music notes that indicate the generation of sound by the performer P to the density of the music notes that indicate the sound generated by the automatic performance instrument 30 (hereinafter referred to as "music note density ratio").

For example, in the present modified example, when the plurality of observation values are selected based on a time filter and when the music note density ratio is higher than a designated threshold value (when the number of music notes of the performance sound of the performer P is relatively large), the selection module 132 can select the plurality of observation values that are used for updating the state variables such that the time length of the time filter (time length of the selection period) becomes shorter compared to when the music note density ratio is less than or equal to the designated threshold value.

In addition, for example, in the present modified example, when the plurality of observation values are selected based on the number of music notes and when the music note density ratio is higher than a designated threshold value, the selection module 132 can select the plurality of observation values that are used for updating the state variables such that the number of selected observation values becomes smaller compared to when the music note density ratio is less than or equal to the designated threshold value.

In addition, in the present modified example, the selection module 132 can change the mode of selecting the plurality of observation values that are used for updating the state variables according to the music note density ratio. For example, when the music note density ratio is greater than a designated threshold value, the selection module 132 can select the plurality of observation values based on the number of music notes, and when the music note density ratio is less than or equal to the designated threshold value, the selection module can select the plurality of observation values based on the time filter.

In addition, in the present modified example, when the observation values are selected according to the number of measures and when the music note density ratio is less than or equal to a designated threshold value (for example, when the number of music notes of the performance sound of the automatic performance instrument 30 is relatively large), the selection module 132 can select the plurality of observation values that are used for updating the state variables such that the number of measures to be the target of the selection of the observation values becomes greater.

The density of the music notes is calculated, for the performance sound of the performer P (sound signal), based on the number of detected onsets, and is calculated, for the performance sound of the automatic performance instrument 30 (MIDI message), based on the number of notes-on messages.

3-8. Eighth Modified Example

In the embodiment and modified examples described above, the predicted time calculating module 134 uses equation (6) to calculate the performance position x[t] at a future time t, but the present embodiment is not limited to such a mode.

For example, the state variable updating module 133 can calculate the performance position x[n+1] using the dynamic model that updates the state vector V. In this case, the state variable updating module 133 can use the following equation (12) or equation (13) instead of the above-described equation (4) or equation (9) as the state transition model. In addition, in this case, the state variable updating module 133 can use the following equation (14) or equation (15) instead of the above-described equation (8) or equation (10) as the state transition model.

Equation $$\begin{pmatrix} x[n+1] \\ v[n+1] \end{pmatrix} = \begin{pmatrix} 1 & T[n]-T[n-1] \\ 0 & \alpha \end{pmatrix} \begin{pmatrix} x[n] \\ v[n] \end{pmatrix} + e[n] \tag{12}$$

$$\begin{pmatrix} x[n+1] \\ v[n+1] \end{pmatrix} = \begin{pmatrix} 1 & T[n]-T[n-1] \\ 0 & \alpha \end{pmatrix} \begin{pmatrix} x[n] \\ v[n] \end{pmatrix} + \begin{pmatrix} 0 \\ (1-\alpha)v_{def}[n] \end{pmatrix} + e[n] \tag{13}$$

$$\begin{pmatrix} u[n] \\ u[n-1] \\ \vdots \\ u[n-j] \end{pmatrix} = o_n \begin{pmatrix} x[n+1] \\ v[n+1] \end{pmatrix} + \begin{pmatrix} q[n] \\ q[n-1] \\ \vdots \\ q[n-j] \end{pmatrix} \tag{14}$$

$$\begin{pmatrix} u[n] \\ u[n-1] \\ \vdots \\ u[n-j] \end{pmatrix} = \begin{pmatrix} 1 & 0 \\ 1 & -T[n]+T[n-1] \\ \vdots & \vdots \\ 1 & -T[n]+T[n-j] \end{pmatrix} \begin{pmatrix} x[n+1] \\ v[n+1] \end{pmatrix} + \begin{pmatrix} q[n] \\ q[n-1] \\ \vdots \\ q[n-j] \end{pmatrix} \tag{15}$$

3-9. Ninth Modified Example

The behavior of the performer P that is detected by the sensor group 20 is not limited to the performance sound. The sensor group 20 can detect a movement of the performer P instead of, or in addition to, the performance sound. In this case, the sensor group 20 includes a camera or a motion sensor.

3-10. Other Modified Examples

The algorithm for estimating the performance position in the estimation module 12 is not limited to that illustrated in the embodiment. Any algorithm can be applied to the estimation module 12 as long as the algorithm is capable of estimating the performance position on the musical score based on the musical score that is given in advance and the sound signal that is input from the sensor group 20. In addition, the observation value that is input from the estimation module 12 to the prediction module 13 is not limited to that illustrated in the embodiment. Any type of observation value other than the sound generation position u and the sound generation time T can be input to the prediction module 13 as long as the observation value relates to the timing of the performance.

The dynamic model that is used in the prediction module 13 is not limited to that illustrated in the embodiment. In the embodiment and the modified examples described above, the prediction module 13 updates the state vector V using the Kalman filter, but the state vector V can be updated using an algorithm other than with the Kalman filter. For example, the prediction module 13 can update the state vector V using a particle filter. In this case, the state transition model that is used in the particle filter can be expressed by equations (2), (4), (9), (12) or (13) described above, or a different state transition model can be used. Additionally, the observation model that is used in the particle filter can be expressed by equations (3), (5), (8), (10), (14) or (15) described above, or a different observation model can be used.

In addition, state variables other than, or in addition to the performance position x and the velocity v can also be used. The equations shown in the embodiment are merely examples, and the present embodiment is not limited thereto.

The hardware configuration of each device that constitutes the ensemble system 1 is not limited to that illustrated in the embodiment. Any specific hardware configuration can be used as long as the hardware configuration can realize the required functions. For example, the timing control device 10 can comprise a plurality of processors that respectively correspond to the estimation module 131, the prediction module 133, and the output module 14, rather than the timing control device 10 functioning as the estimation module 12, the prediction module 13, and the output module 14 by means of a single processor of the electronic controller 101 executing a control program. In addition, a plurality of devices can physically cooperate with each other to function as the timing control device 10 in the ensemble system 1.

The control program that is executed by the processor of the electronic controller 101 of the timing control device 10 can be provided by means of a non-transitory storage medium, such as an optical disc, a magnetic disk, or a semiconductor memory, or can be provided by means of a download via a communication line such as the Internet. In addition, it is not necessary for the control program to include all the steps of FIG. 4. For example, the program can include only Steps S31, S33, and S34.

Preferred Aspects

Preferred aspects that can be ascertained from the descriptions of the embodiment and the modified example above are illustrated below.

First Aspect

A timing prediction method according to a first aspect is characterized by comprising a step for updating a state variable relating to a timing of a next sound generation event in a performance, using a plurality of observation values relating to the timing of the sound generation in the performance, and a step for outputting the updated state variable.

According to this aspect, it is possible to keep the influence of the unexpected deviation in the timing of the sound generation in the performance on the prediction of the timing of the event in the performance low.

Second Aspect

The timing prediction method according to a second aspect is the timing prediction method according to the first aspect, further comprising a step for causing a sound generation means to emit a sound at a timing that is set based on the updated state variable.

According to this aspect, it is possible to cause the sound generation means to emit a sound at the predicted timing.

Third Aspect

The timing prediction method according to a third aspect is the timing prediction method according to the first or second aspect, further comprising a step for receiving two or more observation values relating to the timing of the sound generation in the performance, and a step for selecting the plurality of observation values that are used to update the state variables from among the two or more observation values.

According to this aspect, it is possible to control the magnitude of the influence of the unexpected deviation in the timing of the sound generation in the performance on the prediction of the timing of the event in the performance.

Fourth Aspect

The timing prediction method according to a fourth aspect is the timing prediction method according to the third aspect, wherein the plurality of observation values are selected according to the ratio of the density of music notes that indicate the generation of sound by a performer during the performance to the density of the music notes that indicate the generation of sound by the sound generation means in the performance.

According to this aspect, it is possible to control the magnitude of the influence of the unexpected deviation in the timing of the generation of sound in the performance on the prediction of the timing of the event in the performance according to the music note density ratio.

Fifth Aspect

The timing prediction method according to a fifth aspect is the timing prediction method according to the fourth aspect, further comprising a step for changing the mode of selection according to the ratio.

According to this aspect, it is possible to control the magnitude of the influence of the unexpected deviation in the timing of the sound generation in the performance on the prediction of the timing of the event in the performance according to music note density ratio.

Sixth Aspect

The timing prediction method according to a sixth aspect is the timing prediction method according to the fourth or fifth aspect, wherein, when the ratio is greater than a designated threshold value, the number of the observation values that are selected is decreased compared to when the ratio is less than or equal to the designated threshold value.

According to this aspect, it is possible to control the magnitude of the influence of the unexpected deviation in the timing of the sound generation in the performance on the prediction of the timing of the event in the performance according to the music note density ratio.

Seventh Aspect

The timing prediction method according to a seventh aspect is the timing prediction method according to the fourth or fifth aspect, wherein the plurality of the observation values, from among the two or more observation values, are observation values that are received during a selection period and the selection period is made shorter when the ratio is greater than a designated threshold value than when the ratio is less than or equal to the designated threshold value.

According to this aspect, it is possible to control the magnitude of the influence of the unexpected deviation in the timing of the sound generation in the performance on the prediction of the timing of the event in the performance according to the music note density ratio.

Eighth Aspect

A timing prediction device according to an eighth aspect is characterized by comprising a reception unit for receiving a plurality of observation values relating to a timing of sound generation in a performance, and an updating unit for updating a state variable relating to the timing of a next sound generation event in the performance, using the plurality of observation values.

According to this aspect, it is possible to keep the influence of the unexpected deviation in the timing of the sound generation in the performance on the prediction of the timing of the event in the performance low.

What is claims:

1. A timing prediction method comprising:

receiving two or more observation values relating to a timing of a sound generation in a performance;

selecting a plurality of observation values that are used to update a state variable from among the two or more observation values, the state variable relating to a timing of a next sound generation event in the performance;

updating the state variable, using the plurality of observation values;

outputting an updated state variable that has been updated; and causing a sound generation device to emit a sound at a timing that is set based on the updated state variable;

the plurality of observation values being selected according to a ratio of a density of music notes that indicate generation of sound by a performer in the performance to a density of music notes that indicate generation of sound by the sound generation device in the performance.

2. The timing prediction method according to claim 1, wherein a mode of the selecting is changed according to the ratio.

3. The timing prediction method according to claim 1, wherein in the selecting, when the ratio is larger than a designated threshold value, the number of the plurality of observation values that are selected is decreased compared to when the ratio is less than or equal to the designated threshold value.

4. The timing prediction method according to claim 1, wherein the plurality of observation values are observation values selected from among the two or more observation values during a selection period, and the plurality of observation values are selected such that the selection period when the ratio is greater than a designated threshold value is shorter than when the ratio is less than or equal to the designated threshold value.

5. A timing prediction device comprising:

an electronic controller including at least one processor, the electronic controller being configured to execute a plurality of modules including a reception module that receives two or more observation values relating to a timing of sound generation in a performance, a selection module that selects a plurality of observation values that are used to update a state variable from among the two or more observation values, the state variable relating to a timing of a next sound generation event in the performance, an updating module that updates the state variable, using the plurality of observation values, and outputs an updated state variable that has been updated, and an output module that outputs the updated state variable to cause a sound generation device to emit a sound at a timing that is set based on the updated state variable, the selection module selecting the plurality of observation values according to a ratio of a density of music notes that indicate generation of sound by a performer in the performance to a density of music notes that indicate generation of sound by the sound generation device in the performance.

6. The timing prediction device according to claim 5, wherein the selection module changes a mode of select of the plurality of observation values according to the ratio.

7. The timing prediction device according to claim 5, wherein when the ratio is larger than a designated threshold value, the selection module decreases the number of the plurality of observation values that are selected compared to when the ratio is less than or equal to the designated threshold value.

8. The timing prediction device according to claim 5, wherein the plurality of observation values are observation values selected from among the two or more observation values during a selection period, and the selection module selects the plurality of observation values such that the selection period when the ratio is greater than a designated threshold value is shorter than when the ratio is less than or equal to the designated threshold value.

* * * * *